United States Patent [19]

Davidson et al.

[11] 4,407,589

[45] Oct. 4, 1983

[54] ERROR CORRECTION METHOD AND APPARATUS FOR ELECTRONIC TIMEPIECES

[76] Inventors: John R. Davidson, 266 Nottingham Rd.; Joseph S. Heyman, 130 Indian Springs Rd., both of Williamsburg, Va. 23185

[21] Appl. No.: 234,225

[22] Filed: Feb. 13, 1981

[51] Int. Cl.[3] ..... G04B 17/12

[52] U.S. Cl. ..... 368/201; 368/200; 368/184

[58] Field of Search ..... 368/184, 186, 188, 189, 368/201, 200

[56] References Cited

U.S. PATENT DOCUMENTS

| | | | |
|---|---|---|---|
| 3,914,931 | 10/1975 | Tsuruishi | 368/201 |
| 3,978,649 | 9/1976 | Naito | 368/201 |
| 4,051,663 | 10/1977 | Chihara et al. | 368/201 |
| 4,101,838 | 7/1978 | Aihara et al. | 368/201 |
| 4,114,363 | 9/1978 | Imamura | 368/201 |
| 4,154,053 | 5/1979 | Chetelat et al. | 368/201 |
| 4,159,622 | 7/1979 | Akahane | 368/201 |

*Primary Examiner*—Bernard Roskoski

*Attorney, Agent, or Firm*—Howard J. Osborn; John R. Manning; William H. King

[57] ABSTRACT

A method and apparatus for correcting errors in an electronic digital timepiece that includes an oscillator which has a $2^n$ frequency output, an n-stage frequency divider for reducing the oscillator output frequency to a time keeping frequency, and means for displaying the count of the time keeping frequency. The error E in the time of the timepiece for an arbitrary period of time T is determined. A computer computes a new adjustment value $N+(2^{n-m}+N)E/T$ where N is the preceding adjustment value and m is a nonnegative integer less than n. Then the $2^{n-m}$ divisor of the first n−m stages of the n-stage frequency divider is adjusted in an amount equal to the new adjustment value. In first and second embodiments of the invention the timepiece is synchronized with a time standard at the beginning of the period of time T. In the first embodiment of the invention the timepiece user observes E (the difference between the time standard and the timepiece time at the end of the period T) and then operates a selected switch to correct the time of the timepiece and to obtain a count for E. In the second embodiment of the invention, the user operates a switch at the beginning of T and at the end of T and a count for E is obtained electronically.

14 Claims, 2 Drawing Figures

ERROR CORRECTION METHOD AND APPARATUS FOR ELECTRONIC TIMEPIECES

ORIGIN OF THE INVENTION

The invention disclosed herein was made by employees of the United States Government and may be manufactured and used by or for the Government for governmental purposes without the payment of any royalties thereon of therefor.

BACKGROUND OF THE INVENTION

The invention relates generally to electronic digital watches and clocks, and more specifically concerns a method and apparatus for correcting errors in electronic digital timepieces.

In the past, electronic digital clocks or watches have provided no convenient method for the user to alter the clock rate to match a calibration source or signal. However, most clocks or watches do have, internally, a small adjustable trimmer capacitor that is used to "pull" the resonant frequency of a quartz crystal oscillator that operates, for example, at a frequency of $2^{15}$ Hertz.

The trimmer capacitor is usually initially adjusted so as to set the oscillator frequency equal to a standard. The accuracy can be set to seconds per week. But once set, such things as crystal aging, temperature variations, and wearing habits alter the clock rate. The clock rate is almost never adjustable from outside the clock or the watch. Furthermore, to set the oscillator to one second per week (about one part in $2^{19}$) requires setting the frequency to an equal accuracy. This is especially difficult because altering the clock case configuration by opening or closing it changes the influence of the case's stray capacitance on the oscillator frequency; in addition, this influence varies from watch to watch.

Of even greater importance is that the great majority of users lack sophisticated calibration equipment and are unable to easily or simply adjust the clock or watch rate even if the adjustment can be made externally. Most users have access only to time signals broadcast on local radio stations. The user must turn the trimmer adjustment through a small angle then wait a week or so to observe the effect. Based on the result, he then readjusts the trimmer and observes the result after another week; often, a third iterative adjustment is needed to arrive at an accuracy near one second per week.

It is the primary object of this invention to provide a method and apparatus for altering the clock rate of a timepiece to match a calibration source or signal.

Another object of this invention is to provide a timepiece in which the user, by means of external pushbutton controls, can easily and simply adjust the clock rate to a time standard.

A further object of this invention is to provide a method and apparatus for changing the clock rate of a timepiece without changing the frequency of the timepiece oscillator.

Still another object of this invention is to provide a method and apparatus for correcting the clock rate of a timepiece that does not require iterative adjustments to a reference frequency or rate.

Other objects and advantages of this invention will become apparent hereinafter in the specification and drawings.

SUMMARY OF THE INVENTION

A prior art electronic digital timepiece consists essentially of a $2^n$ oscillator, a $2^n$ frequency divider for changing the oscillator frequency to a time keeping frequency, and a display for displaying the count of the time keeping frequency in seconds, minutes, hours and days. In a first embodiment of the invention the time of the timepiece is synchronized with a standard time. Then after an arbitrary time T the error E accumulated by the timepiece during T is determined by a pushbutton control circuitry that includes the last m stages of the frequency divider. The pushbutton control circuitry either increases or decreases the time keeping frequency until the time on the display is again synchronized with the standard. The time that the pushbutton control circuitry is used is proportional to E. Separate counting means are used to count the cycles at the output of the (n−m)th stage of a frequency divider during the time the pushbutton control circuitry is used (E counter) and during the time period T (T counter). The output of the E counter is divided by the output of the T counter, multiplied by $(2^{n-m}+N)$, and then added to N to produce a divisor correction for the first (n−m) stages of the frequency divider. N is the last preceding correction of the divisor.

In a second embodiment of the invention the error E is determined by disconnecting the display logic of the timepiece from the display register and setting the display register forward to a time when a standard time signal is anticipated. A time register continues to register the time keeping frequency from the frequency divider. At the instant the anticipated standard time signal occurs the difference between the time register and the display register is obtained. This difference is a measure of E and is used to correct the frequency divider as in the first embodiment.

DETAILED DESCRIPTION OF THE INVENTION

Figure 1:
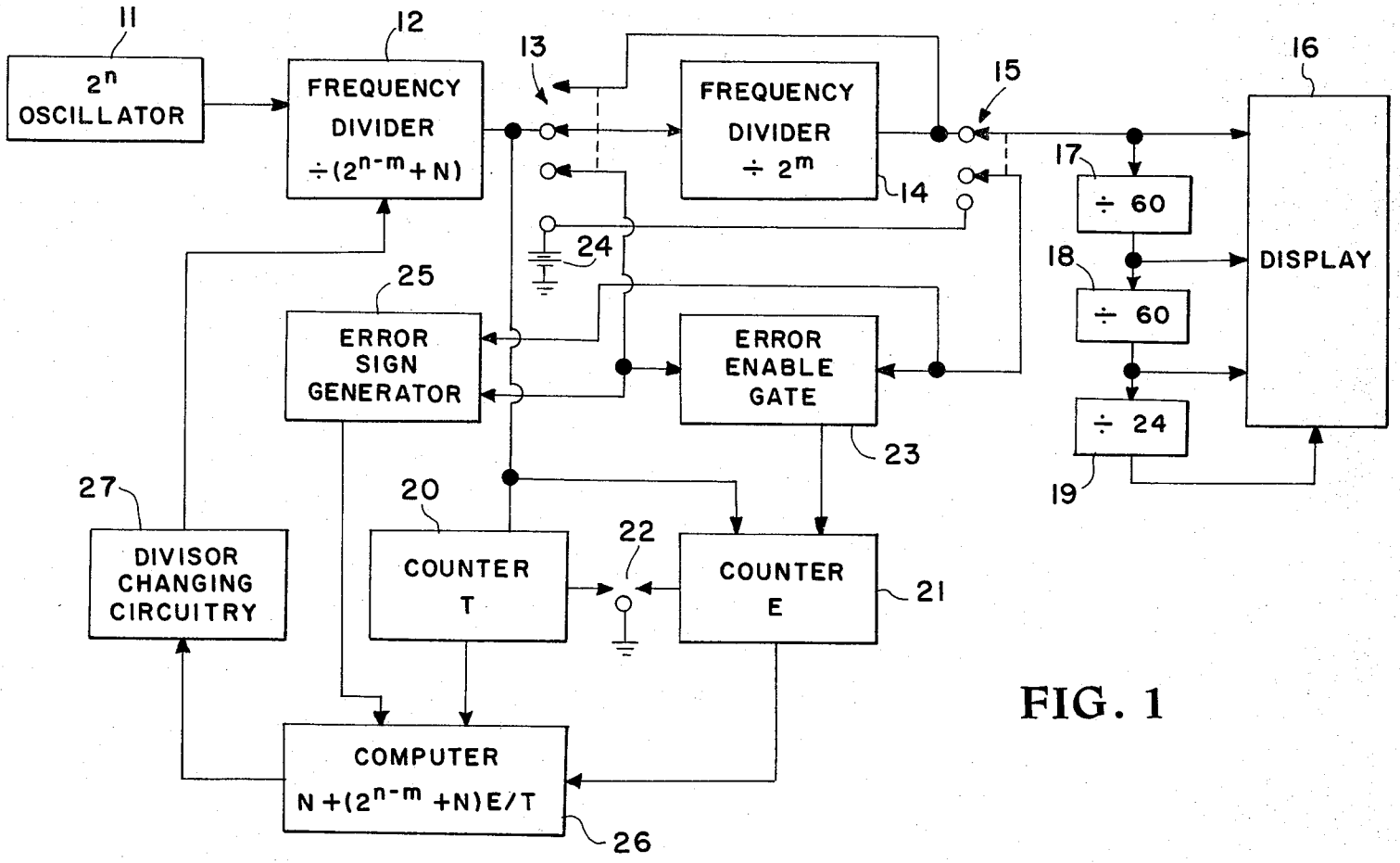
FIG. 1 is a block diagram of a first embodiment of the invention.

Turning now to the embodiment of the invention selected for illustration in FIG. 1, the number 11 designates an oscillator that normally has a frequency of $2^n$ where n is positive integer, such as, for example 15. With use the frequency of oscillator 11 will change. It is the purpose of this invention to compensate for the changes in frequency of oscillator 11.

The output frequency of oscillator 11 is divided by $2^{n-m}+N$ with a frequency divider 12, where m is a positive integer less than n and where N is the last preceding correction made by the apparatus hereinafter described. The output frequency of frequency divider 12 is connected through a pushbutton switch 13 to a frequency divider 14, which divides the frequency by $2^m$. The resulting frequency, which should be one Hertz, passes through a pushbutton switch 15 to a display 16. The one Hertz frequency is also divided by 60 with a divider 17 and applied to the display, further divided by 60 with a divider 18 and applied to the display, and further divided by 24 with a divider 19 and applied to the display so that the time is displayed in seconds, minutes, hours and days.

The output of frequency divider 12 is connected to counters 20 and 21, which count the output frequency of divider 12 for periods of time T and E, respectively. The period of time T is an arbitrary period and E is the error accumulated by the timepiece during T. A pushbutton switch 22 provides means for simultaneously resetting counters 20 and 21 to zero. An error enable gate 23 provides means for controlling counter 21. With pushbutton switches 13 and 15 in the positions shown, no potential is applied to either input terminal to gate 23 or to generator 25. As a result, gate 23 disables counter 21 and generator 25 does not generate a sign signal. When switch 13 is pushed down to its other position a potential 24 is applied to one of the input terminals, to gate 23 and to generator 25. As a result gate 23 enables counter 21 and generator 25 produces a signal indicative of a negative sign. When switch 15 is pushed down to its other position potential 24 is applied to the other input terminal to gate 23 and to generator 25. As a result, gate 23 enable counter 21 and generator 25 produces a signal indicative of a positive sign.

A computer 26 receives the sign signal from generator 25 and the counts from counters 20 and 21 and computes $N+(2^{n-m}+N)E/T$, the new adjustment value, which is inserted into frequency divider 12 in place of N by means of divisor changing circuitry 27.

One way to insert the new adjustment value computed by computer 26 in place of the preceding adjustment value N in frequency divider 12 is to let frequency divider 12 be comprised of a conventional frequency divider having $2^{n-m}$ stages with its input connected to an auxiliary frequency divider (any desired number of stages) which is fed by oscillator 11. Then when the new computed adjustment value is negative the auxiliary frequency divider is set to a "1" in each of its stages and is reset each time it produces an output pulse to the $2^{n-m}$ stage divider. In addition, the new computed adjustment value is inserted into the $2^{n-m}$ stage frequency divider and is reset to this value each time the divider produces an output pulse. When the new computed value is positive "0"s are set into each stage of the $2^{n-m}$ stage divider and are reset to "0"s when the divider produces an output pulse. The "1"'s complement of the new adjustment value is set into the auxiliary divider and all stages are reset to "1" each time the auxiliary divider produces an output pulse until the $2^{n-m}$ stage divider produces a pulse then the auxiliary divider is reset to the "1"'s complement of the new adjustment value. Hence, when the new computed adjustment value is either positive or negative the new divisor for frequency divider 12 is $2^{n-m}$ plus the new value.

The user of the timepiece in FIG. 1 can utilize this invention in the following way. It will be assumed that m is equal to one inasmuch as that is considered to be the best mode of the invention. First, the user will synchronize the display 16 with a time standard and push switch 22 which will reset counters 20 and 21 and start the count on counter 20. This is the beginning of a period of time T. Then when the correction is to be made the time on display 16 is compared with the standard time. If the display is slow switch 13 is pushed which connects the output of frequency divider 12 directly to display 16. Since the frequency at the output of divider 12 is approximately 2 Hertz the display will begin to catch up with the time standard. At the same time counter 21 begins to count and generator 25 applies a negative sign signal to computer 26. When the display is again synchronized with the time standard the user releases switch 13 thereby changing back to the normal mode of operation. The count on counter 21 is proportional to E, the error generated by the timepiece during the time period T. The count on counter 20 is proportional to the time period T. If the display is fast, switch 15 is pushed which disconnects the output of divider 14 from the display 16. At the same time counter 21 begins to count, a generator 25 applies a positive sign signal to computer 26. When the display is again synchronized with the time standard the user releases switch 15 thereby changing back to the normal mode of operation. The resulting counts on counters 20 and 21 are proportional to T and E, respectively.

In a more specific explanation of how a user can utilize the invention disclosed in FIG. 1, it will be assumed that display 16 is synchronized with a time standard and at the same time switch 22 is activated. This causes counter 20 to start counting, counter 21 does not start counting at this time because it is not activated by gate 23. Now suppose at the end of some arbitrary period $T-|E|$ the display 16 is compared with the time standard and found to be 35 seconds slow. Then switch 13 is held in its down position for 35 seconds with the aid of the time standard or a different timepiece. During this 35 second period counter 21 counts to provide the E count and counter 20 continues to count to provide the T count. Also during this 35 second period frequency divider 12 is connected directly to the display 16. Assuming $m=1$, 70 pulses will be applied to display 16 during the 35 second period thereby again synchronizing display 16 with the time standard. Now assume that when the comparison with the time standard is made display 16 is 35 seconds fast. Then switch 15 is held in its down position for 35 seconds. The operation is as above except display 16 is disconnected for 35 seconds to thereby synchronize it with the time standard.

In the operation of the embodiment of the invention shown in FIG. 1, it will be assumed that after a period of time T the error in the time registered on display 16 is E. Hence, during the time period T the time on display 16 increased $T+E$ where E can be either positive (fast) or negative (slow). This means that the average frequency applied to display 16 during the period, T, was equal to $(1+E/T)$ Hertz, the average frequency at the output of frequency divider 12 was $2^m(1+E/T)$ Hertz, and the average frequency at the output of oscillator 11 was $(2^n+N2^m)(1+E/T)$ Hertz. The count on counter 20 after the period T is $2^m(1+E/T)T$ and the count on counter 21 after the period E is $2^m(1+E/T)T$. When the count on counter 21 is divided by the count on counter 20 by computer 26, E/T is obtained. When the value for $N+(2^{n-m}+N)E/T$ is computed by computer 26 and this value is substituted for the preceding N in frequency divider 12 the new divisor for divider 12 becomes $2^{n-m}+N(2^{n-m}+N)E/T$ which is equal to $(2^{n-m}+N)(1+E/T)$. The resulting frequency at the output of frequency divider 12 is $2^m$ Hertz and the frequency to display 16 is one Hertz which is the correct time keeping frequency.

Figure 2:
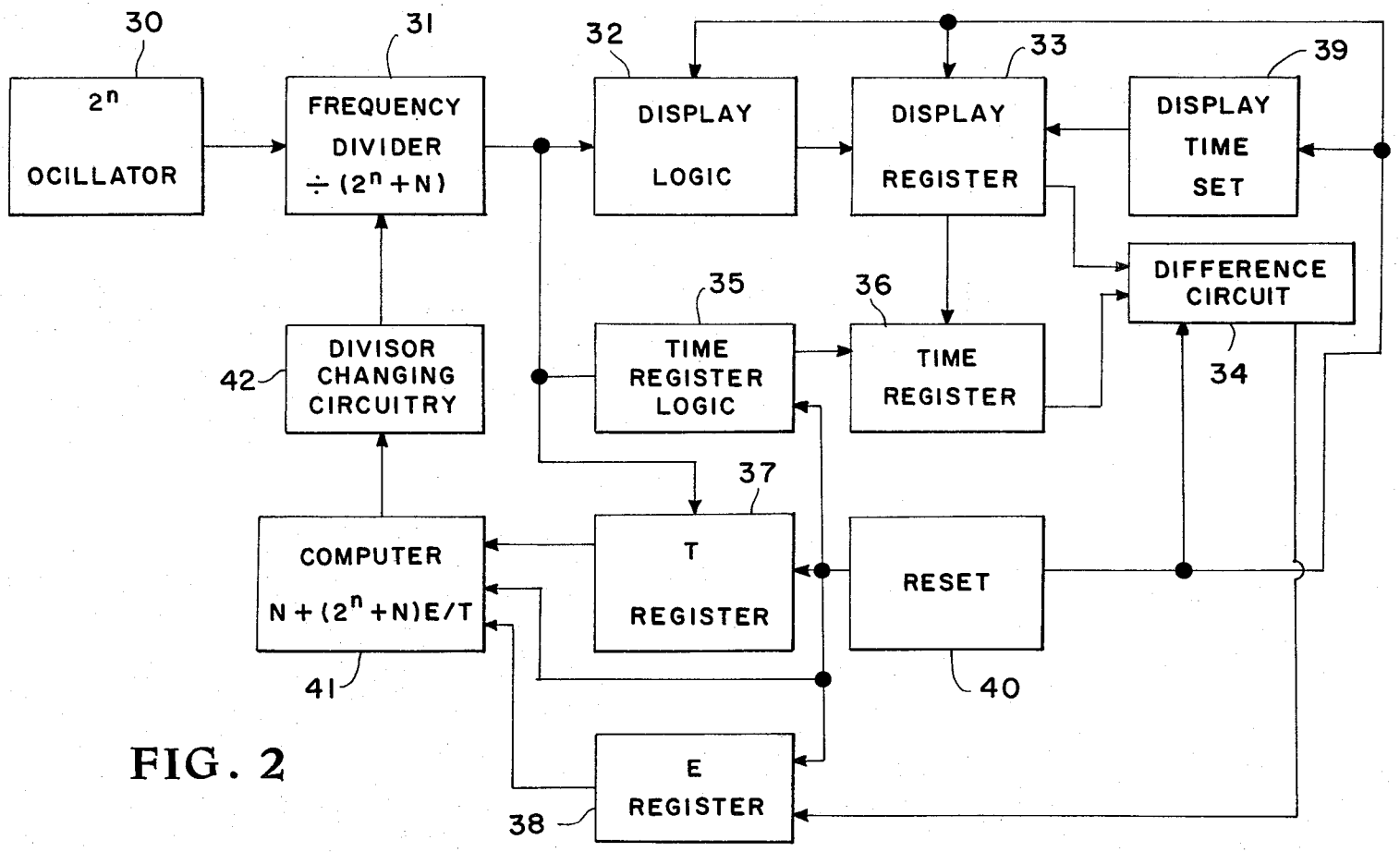
FIG. 2 is a block diagram of a second embodiment of the invention.

In the embodiment of the invention shown in FIG. 2, m is equal to zero. An oscillator 30 initially generates a frequency of $2^n$ which is applied to a frequency divider 31 that has a divisor of $2^n+N$ where N is the preceding adjustment value. The output of divider 31 is applied through a display logic 32 (17, 18 and 19 in FIG. 1) to a display resister 33. The output of divider 31 is also applied to a T register 37 and through a time register logic 35 to a time register 36. The outputs of display resister 33 and time register 36 are applied to a difference circuit 34 to produce a value E which is applied to an E register 38. The outputs of registers 37 and 38 are applied to a computer 41 which computes the value $N+(2^n+N)E/T$. This adjustment value is substituted for the preceding adjustment value N in divisor 31 by means of a divisor changing circuitry 42. A display time set 39 is utilized by the user to set display register 33 to any time desired and disconnect display logic 32 from the display register. A reset 40 loads the difference between registers 33 and 36 from the difference circuit 34 into resister 38 at which time the designated computation is made by computer 41, registers 37 and 38 are each reset to zero, logics 32 and 35 are reset, the time on register 33 is loaded into register 36 and display logic 32 is reconnected to display register 33.

In the use of the embodiment of the invention shown in FIG. 2, the user sets the display register 33 to a time (for example, 6:00 P.M.) when he knows there will be a time signal (for example a time tone from a radio station). Then when the tone occurs, he pushes the reset button which automatically causes the new adjustment value computed by computer 41 to be inserted into register 31 in place of N and starts a new time calibration period T.

The operation of the embodiment of the invention shown in FIG. 2 starts at the time the reset 40 is operated. At that instant a new period of time T is begun and the time in display register 33 is dumped into time register 36 synchronizing that register with a time standard. During the time period T time register 36 registers the time keeping pulses produced by frequency divider 31. Before the end of time period T the display register 33 is set to a future time when a time standard tone is anticipated. When the time standard tone is heard the reset 40 is operated causing the time in display register to be subtracted from the time in time register 36 to produce E. The other circuitry operates the same as the equivalent circuitry in FIG. 1.

Circuitry that can be used for the circuitry disclosed functionally in FIGS. 1 and 2 will be apparent to one having ordinary skill in the electronic computing art and is therefore not disclosed specifically in this specification.

The advantages of this invention are that it provides a simple inexpensive method and apparatus for the user of a timepiece to adjust the clock rate of the timepiece to a time standard.

It is to be understood that forms of the invention herewith shown and described are to be taken as preferred embodiments of the invention. However, various changes can be made without departing from the spirit or scope of the invention as described in the subjoined claims. For example, when m is greater than one in FIG. 1 E is no longer exactly equal to the time that switch 13 is actuated. Hence, there must be a proportionality constant introduced in computer 26. Also when switch 15 is activated divider 14 is disconnected from display 16. Alternatively another divider could be connected between divider 14 and display 16 when switch 15 is activated. In this event another proportionality constant must be used in computer 26.

What is claimed is:

1. A method of correcting errors in an electronic digital timepiece that includes an oscillator which has a $2^n$ frequency output, an n stage frequency divider for reducing the oscillator output frequency to a time keeping frequency, and means for displaying the count of the time keeping frequency comprising the steps of:

synchronizing the timepiece with a time standard, at the beginning of an arbitrary time period T;

counting the output of the (n−m)th stage of said frequency divider during the period of time T where m is a non-negative integer less than n;

obtaining a count of the output of the (n−m)th stage of said frequency divider for the period of time $|E|$ where E is the error made by said timepiece during said time period T and is the difference between the time registered by the timepiece and the time standard at the end of the time period T;

dividing the obtained count for E by the count for the period of time T and multiplying by $(2^{n-m}+N)$ and then adding N to obtain a new adjustment value where N was the preceding adjustment value; and adjusting the $2^{n-m}$ divisor of the first (n−m) stages of said frequency divider by the amount of said new adjustment value.

2. A method of correcting errors in an electronic digital timepiece according to claim 1 wherein said step for obtaining a count for E includes the step of counting the output of the (n−m)th stage of said frequency divider for the period of time $|E|$.

3. A method of correcting errors in an electronic digital timepiece according to claim 1 wherein said step for obtaining a count for E comprises the steps of:

synchronizing a time register with said time standard at the beginning of said time period T;

subtracting the time in said time register from said time standard at the end of said time period T to obtain said count for E.

4. A method according to claim 1 wherein m is a positive integer less than n.

5. A method according to claim 1 wherein said step of counting the output of the (n−m)th stage of said frequency divider for a period of time $|E|$ includes the steps of:

at the end of said time period T changing the frequency of the count to the display means until the time on the display means is again synchronized with said standard time; and counting the output of the (n−m)th stage of said frequency divider during the time that the frequency to the display means is changed.

6. A method according to claim 5 wherein said step of changing the frequency of the count to the counting and display means consists of doubling the frequency of the count if the counting and display means is slow and changing the frequency of the count to zero if the counting and display means is fast.

7. In an electronic digital timepiece that includes an oscillator that has a $2^n$ frequency output, an n stage frequency divider for reducing the oscillator output frequency to a time keeping frequency, and means for counting and displaying the count of the time keeping frequency, apparatus for correcting errors in said timepiece due to changes in the output frequency of said oscillator comprising:

a first counting means connected to the output of the (n−m)th stage of said frequency divider where m is a whole number less than n and greater than zero;

a second counting means connected to the output of the (n−m)th stage of said frequency divider;

means for activating said first counting means for a selected period of time T whereby the first counting means counts the output of the (n−m)th stage of said frequency divider during the period T;

means for activating said second counting means for a period of time |E| where |E| is equal to the error accumulated by said time piece during said period T;

means for dividing the count on said second counting means by the count on said first counting means, multiplying by $(2^{n-m}+N)$ and adding N to produce a new adjustment value where N is the preceding adjustment value; and means for adjusting the $2^{n-m}$ divisor of the first (n−m)th stages of said frequency divider by the amount of said new adjustment value.

8. In an electronic digital timepiece according to claim 7 wherein said means for activating said second counting means for a period of time |E| comprises:

a first switching means for activating said second counting means and for increasing the time keeping frequency when E is slow; and a second switching means for activating said second counting means and for slowing the time keeping frequency when E is fast.

9. In an electronic digital timepiece according to claim 8 wherein said first and second switching means includes means for transmitting to said means for adjusting the divisor of the first (n−m)th stages of said frequency divider a signal indicative of whether E is fast or slow.

10. In an electronic digital timepiece according to claim 8 wherein said first switching means for increasing the time keeping frequency includes means for connecting the output of the (n−m)th stage of said frequency divider directly to the counting and display means.

11. In an electronic digital timepiece according to claim 8 wherein said second switch means for increasing the time keeping frequency includes means for disconnecting the frequency divider from the counting and display means.

12. In an electronic digital timepiece according to claim 8 wherein m is equal to one.

13. In an electronic digital timepiece that includes an oscillator having a $2^n$ frequency output, an n-stage frequency divider divider for reducing the oscillator frequency to a time keeping frequency, and a display time register counting and displaying the count of the time keeping frequency, apparatus for correcting errors in the timepiece due to changes in the output frequency of said oscillator comprising:

a first register for counting the output frequency from said n-stage frequency divider for an arbitrary period of time T;

a second time register for registering the time as produced by the output of said n-stage frequency divider;

means for synchronizing said second time register with a time standard at the beginning of said time period T;

means for obtaining the error E of the time in said second time register as compared to said time standard at the end of said time period T;

computer means receiving the output of said first register means and said means for obtaining the error E for calculating a new adjustment value:

$$N+(2^n+N)E/T$$

where N is the preceding adjustment value; and means for adjusting the $2^n$ divisor of the frequency divider by the amount of the new adjustment value.

14. A method of correcting errors in an electronic digital timepiece that includes an oscillator which has a $2^n$ frequency output, an n stage frequency divider for reducing the oscillator output frequency to a time keeping frequency, and means for displaying the count of the time keeping frequency comprising the steps of:

synchronizing the timepiece with a time standard, at the beginning of an arbitrary time period T;

counting the output of the (n−m)th stage of said frequency divider during the period of time T where m is a non-negative integer less than n;

counting the output of the (n−m)th stage of said frequency divider during the period of time |E| where E is the error made by the timepiece during the period of time T;

dividing the count for the period of time |E| by the count for the period of time T and multiplying by $(2^{n-m}+N)$ and then adding N to obtain a new adjustment value where N was the preceding adjustment value; and adjusting the $2^{n-m}$ divisor of the first (n−m) stages of said frequency divider by the amount of said new adjustment value.

* * * * *